US006913543B2

(12) United States Patent
Chapman et al.

(10) Patent No.: US 6,913,543 B2
(45) Date of Patent: Jul. 5, 2005

(54) GOLF SWING CONDITIONER

(76) Inventors: David F. Chapman, P.O. Box 556, Tupelo, MS (US) 38802-0556; Truman Vincent Cole, 1708 Oakview Dr., Tupelo, MS (US) 38804; Kevin Paul Cavaretta, P.O. Box 556, Tupelo, MS (US) 33802-0556

( * ) Notice: Subject to any disclaimer, the term of this patent is extended or adjusted under 35 U.S.C. 154(b) by 0 days.

(21) Appl. No.: 10/417,441

(22) Filed: Apr. 15, 2003

(65) Prior Publication Data

US 2004/0152534 A1 Aug. 5, 2004

Related U.S. Application Data

(63) Continuation of application No. 09/810,733, filed on Mar. 16, 2001, now abandoned, and a continuation of application No. PCT/US01/08459, filed on Mar. 16, 2001.

(60) Provisional application No. 60/190,397, filed on Mar. 17, 2000.

(51) Int. Cl.[7] ..... A63B 69/36; A63B 21/22

(52) U.S. Cl. ..... 473/257; 473/229; 482/112; 434/252

(58) Field of Search ..... 473/266, 271, 473/272, 275, 276, 219, 229; 434/252; 482/112

(56) References Cited

U.S. PATENT DOCUMENTS

| | | | | | |
|---|---|---|---|---|---|
| 3,926,430 | A | * | 12/1975 | Good, Jr. | 482/112 |
| 4,249,762 | A | * | 2/1981 | Richards | 473/256 |
| 5,125,882 | A | * | 6/1992 | La Mothe et al. | 482/114 |
| 5,242,344 | A | * | 9/1993 | Hundley | 482/93 |
| 5,711,717 | A | * | 1/1998 | Richards | 473/229 |
| 5,888,146 | A | * | 3/1999 | Raynak | 473/229 |

* cited by examiner

*Primary Examiner*—Gregory Vidovich
*Assistant Examiner*—Nini F. Legesse
(74) *Attorney, Agent, or Firm*—Phelps Dunbar, LLP

(57) ABSTRACT

The present invention is a piece of exercise equipment designed to train and condition sport-specific muscle groups used during a swinging motion, as in golf. It is comprised of a mechanical linkage, with at least six free-moving joints, so that it effectively simulates a wide variety of golf swings without the need for complex adjustments and provides for smooth and even distribution of resistance to the various muscle groups involved in the swinging motion. It includes a resistance mechanism, such as a pulley system linked to two one-way hydraulic cylinders. This allows a user to simultaneously practice swing form and technique while also strengthening and conditioning the specific muscles needed for the sport.

16 Claims, 14 Drawing Sheets

GOLF SWING CONDITIONER

This application is a continuation of 09/810,733 Mar. 16, 2001 abandoned, which claims benefit of provisional 60/190,397, Mar. 17, 2000 and is a continuation of PCT/US01/08459 Mar. 16, 2001.

BACKGROUND OF THE INVENTION

As almost anyone who has recently tried a new sport can attest, different sports often require the use of different muscles. Even if a person is generally fit (as through a regular exercise routine), they will often find that the particular movements required by different sports will work previously untested muscles or will work tested muscles in a different way, causing muscle soreness and tightness the next day. The reason for this is that different sports work different muscle groups through different ranges of motion. Consequently, for more advanced participants of a sport, it may be more desirable to train the specific muscle groups for their particular sport using the specific movements for their particular sport rather than to attempt to improve through a more general, unfocused exercise routine.

The most typical way to train sport-specific muscle groups is actually practicing the sport itself. While actually practicing the sport would obviously work the appropriate muscle groups through the appropriate range of motion, it typically would not produce the same sort of results (in terms of strengthening muscles) as strength-resistance training (i.e. free weights or circuit machines). So, it may be useful, especially to more advanced participants of a sport, to have exercise equipment which is specifically designed to apply strength-resistance training to the muscle groups used to play their particular sport. And, such equipment would be even more useful if it allowed the user to work the appropriate muscle groups smoothly and evenly through the appropriate range of motion as the user also worked on technique and form, essentially developing muscle memory for their particular sport.

One such sport, which could use this type of specific strength-resistance training of specialized muscle groups through a particular range of motion, is golf. While there are currently existing devices, such as that disclosed in U.S. Pat. No. 4,261,573, which simulate a golf swing (such that a user may in essence practice the sport indoors in limited space in order to improve swing technique and form), these devices do not provide the simultaneous benefit of strength-resistance training to condition the specific muscle groups. Further, the existing devices require a user to pre-set the device in order for it to be appropriate for the particular user (according to height, stance, arc of swing, lie angle, etc).

The present invention of the Golf Swing Conditioner ("GSC") includes a mechanical linkage, which simulates a golf swing, and resistance-type training. The GSC has sufficiently flexible degrees of freedom of motion to allow various users to simulate the full range of motion of their golf swing without the need for complex adjustments; in the preferred embodiment, the GSC's design automatically adjusts to fit each particular user. In addition to allowing various users to employ the GSC without the need to make adjustments, the movement planes of the GSC also accommodate users who have an unusual or extraordinary swing, such that they may condition their muscles through the actual range of motion in their actual swing (as opposed to some idealized version of a swing). Finally, the mechanical linkage of the GSC is characterized by movement planes that allow for resistance to be smoothly and evenly distributed to muscle groups throughout the swinging motion, so that all sports-specific muscles may be trained appropriately. And, in the preferred embodiment, the GSC allows users to adjust the amount of strength-resistance training so that it is appropriate to their strength level. Thus, the GSC is a more complete exercise-training machine for golfers to use in improving the technique, form, and strength of their swing and developing sport-specific muscle memory. Of course, the GSC is not limited to use in simulating, training, and conditioning for golf. The GSC may be configured for use in training for any sport which includes a swinging motion, such as baseball, tennis, or racketball; golf is only one such application.

SUMMARY OF INVENTION

The Golf Swing Conditioner ("GSC") is essentially comprised of a mechanical linkage, which simulates the swinging of a club through its entire range of motion and which adjusts automatically to the specific characteristics of a particular user, such as their height, their swing technique, and the lie, and a resistance mechanism, which applies resistance to the motion of the mechanical linkage in order to strengthen and condition the various muscle groups used during the swing. Generally, the mechanical linkage is supported by a vertical frame, although the mechanical linkage could also be attached to a wall, attached to hang down from a ceiling, or attached to any other type of rigid support structure, which supports the mechanical linkage and holds it up such that it hangs down above the floor. The frame may also include a base platform on which the user would stand. The resistance mechanism is also attached to the frame, typically on the opposite side of the frame away from the mechanical linkage for safety and convenience. The resistance mechanism interacts with the mechanical linkage so that any movement of the mechanical linkage must overcome the resistance imposed by the resistance mechanism. So, when users swing the mechanical linkage to simulate their actual swing, they will receive the benefit of strength-resistance training for the specific muscle groups used during a swing while also practicing their form and technique.

In order to be fully effective, such that it allows different users to move through the entire range of motion of their particular swing while simultaneously smoothly incorporating resistance training and adjusting automatically to specific characteristics of a particular user, the mechanical linkage must provide at least six degrees of freedom of motion. More specifically, the mechanical linkage is constructed so that it can move through six different movement planes. That is to say that, typically, the mechanical linkage must allow lateral movement left-to-right in relation to the user (with the arm pivoting about its connection to the frame), depthwise movement towards-and-away-from the user and the frame (with the arm pivoting about its connection to the frame), sliding movement of the handle gripped by the user along the arm of the mechanical linkage (depthwise towards-and-away-from the user, and, if such movement is not purely horizontal, this may also allow for automatic height adjustment), rotary movement of the handle in rotation about the arm, pivotal movement of the handle about a hinge, and rotary movement of the handle about its own center axis. The six free-moving joints in the mechanical linkage provide for the full, unfettered swinging motion and even resistance distribution necessary for this type of sports-specific resistance training.

More specifically, the mechanical linkage is comprised of at least two elements linked together in such a way as to provide the appropriate degrees of freedom of motion: an arm and a handle. The arm is typically the larger element. The top portion of the arm rotatably (both laterally and depthwise) attaches at a joint to the frame, such that the arm has two different movement planes: lateral rotation and depthwise pivoting. The arm hangs down from the frame, held above and not contacting the floor. Furthermore, the arm must not contact the frame or the floor (i.e. base platform) as it is swung through its full range of motion. At least some portion of the arm must angle towards the user (i.e. the entire arm cannot be vertical). This may be accomplished by having the bottom portion of the arm bend towards the user sharply, so that it is essentially horizontal and parallel to the floor, or it may be accomplished by having the bottom portion angle less sharply towards the user's feet, such that it is not parallel to the floor but presents a declining angle. If the bottom portion of the arm is essentially parallel to the floor, then the GSC will not automatically adjust to users of different height but will instead require a height setting of the arm and/or frame using, for example, a pop pin to control the height of the arm above the floor; if the bottom portion of the arm extends at a declining angle towards the feet of the user such that it is not essentially horizontal, however, then the GSC will automatically adjust for users of various heights. While it is possible to have the entire length of the arm angle away from the frame and down towards the floor near the user (i.e. a single straight rod at a decline), it is typically more practical to have the bottom portion of the arm angled away from the frame much more sharply so that the mechanical linkage does not require as much space to operate (i.e. to make the GSC more compact).

When the arm includes a bend or two elements linked together at an angle, the arm can be constructed of a single element with an essentially straight upper portion and an angled bend leading into an essentially straight lower portion so that the lower portion extended away from the upper portion at some angle. Or, in its most typical configuration, the arm of the mechanical linkage would be further comprised of two rods rigidly attached together at some angle, wherein the upper rod of the arm would be the largest portion of the arm and would hang down from the joint near the top of the frame nearly vertically, with only a slight angle away from the frame, while one end of the lower rod of the arm would be rigidly attached to the bottom end of the upper rod, and the lower rod would angle away from the frame with less slope (i.e. less vertically and more towards horizontal) than the upper rod, such that it reaches out towards the user.

Attached to the bottom of the arm and most typically, when there are two rods forming the arm, to the lower rod of the arm, at a connector mechanism that is pivotal (about a hinge), rotatable about the lower rod of the arm, and slidable along the length of the lower rod of the arm, is a handle. The handle of the GSC simulates the handle of the club to be swung and provides the location for the user to grip the mechanical linkage and to swing the mechanical linkage through the appropriate range of motion in order to use the GSC. The handle is also rotatable about its own center axis. Typically, the handle is further comprised of an inner rod, which is pivotally attached at the connector to the lower rod of the arm, and a cylindrical outer sleeve casing, which is free to rotate about the center axis of the handle. So, the user would address the handle of the GSC as if it were the handle of a golf club and would use the handle to swing the mechanical linkage in simulation of an actual golf swing.

Because of the six movement planes available, the mechanical linkage allows users to perform their actual swing through the full range of motion without undue restriction, such that the linkage accommodates the varying swings of different users so that they may practice their particular form and technique. The mechanical linkage, with its six free-moving joints, also ensures the smooth and even transmission of resistance, so that all sports-related muscle groups are effectively trained at an appropriate level (i.e. the resistance training does not target specific muscle groups to the exclusion of others, but works all of the muscle groups used in the swinging motion at an effective level). And, when the bottom rod of the arm is angled downward rather than horizontal towards the user, the linkage automatically adjusts to varying heights of users as the handle slides up and down along the angled bottom rod of the arm. When the bottom rod is essentially horizontal and parallel to the floor as it extends towards the user, the arm must also include a means, such as a pop pin at the joint connecting the rod to the frame, for adjusting the height of the arm to accommodate different size users. Used alone, without a resistance mechanism, the mechanical linkage would allow users to simulate and practice their swing without restriction through the full range of motion, and could serve as a teaching/practice tool.

For simultaneous strength-resistance training the mechanical linkage is connected to a resistance mechanism, such that lateral rotation of the arm of the mechanical linkage is resisted. Typically, the resistance mechanism is located on the opposite side of the frame from the mechanical linkage, for safety and convenience, to keep the moving parts of the resistance mechanism away from users in order to reduce the chances of injury and to reduce the required clearance between the mechanical linkage and the frame while still allowing a full range of motion, but such placement is not required. The resistance mechanism interacts with the lateral rotation of the arm to provide the resistance needed for strength training. And, although not required, typically the resistance mechanism is adjustable, so that particular users may set the resistance level to meet their particular needs.

Any resistance mechanism which can be applied to a rotary input will function in the GSC. There are several different types of resistance mechanisms available, including hydraulic, mechanical (such as friction clutch, weighted pulleys, rotary actuators, hydraulic pumps, air resistance fan blades), and electromagnetic options. The most typical resistance mechanisms employ one or more hydraulic cylinders connected to the rotary input (i.e. the lateral rotation of the linkage arm) by a train of mechanical elements that converts the rotary input into linear motion of the pistons in the hydraulic cylinders. Although there are numerous possible configurations, one simple example configuration uses a pulley system with two one-way hydraulic cylinders, while other examples include a lever-connecting-rod-rocker-bar system, a sprocket-chain-rocker-bar system, and an offset-lever system. Although a person skilled in the art field will appreciate the wide array of potential choices of mechanical elements available to allow such linear hydraulic cylinder resistance to interact with the rotational motion of the arm of the mechanical linkage, several illustrative examples will be set forth in more detail below in the preferred embodiment section. Furthermore, a person skilled in the art field will appreciate the wide variety of resistance mechanisms available, and that hydraulic cylinders are only one of many possibilities. The present invention includes all such interchangeable elements, with hydraulic cylinders used only for illustrative purposes.

The primary object of this invention is to allow users to simulate and practice their swing for a particular sport through a full range of motion without restriction. It is still another object of this invention to provide strength-resistance training of the specific muscle groups used during such a swing. It is yet another object of this invention to simultaneously allow users to simulate their swing and to strengthen the particular muscle groups used during such a swing using resistance to develop strength in the appropriate muscle groups throughout the entire actual range of motion of their swing. It is yet another object to develop muscle memory for the user's swing. It is yet another object for the invention to be usable by users of different heights without the need for adjustments. It is yet another object to allow users to alter the amount of resistance applied throughout the swing. It is yet another object for this invention to be durable. It is yet another object for this invention to provide a smooth, continuous swing. It is yet another object for this invention to be constructed of parts sized for shipment to consumers in standard mailing boxes. These and other objects will be apparent to persons skilled in the art field.

A person skilled in the art field will also appreciate that several different varieties of resistance mechanisms would function in the present invention. While some examples will be discussed herein, these are only intended as illustrations of common resistance mechanisms; the present invention is not limited to these examples. And, a person skilled in the art field will also appreciate that the present invention is not limited to use in simulating, practicing, conditioning, and/or strengthening for golf Although the preferred embodiment will be discussed in terms of training for golf, the present invention may also be used to train for other sports involving a swinging motion (such as baseball, racketball, and tennis). Further, the present invention may also be used for non-sports-related activities, such as for a general exercise routine or for physical therapy and rehab work.

BRIEF DESCRIPTION OF THE DRAWINGS

Reference will be made to the drawings wherein like parts are designated by like numerals and wherein.

DETAILED DESCRIPTION OF THE PREFERRED EMBODIMENTS

Figure 1:
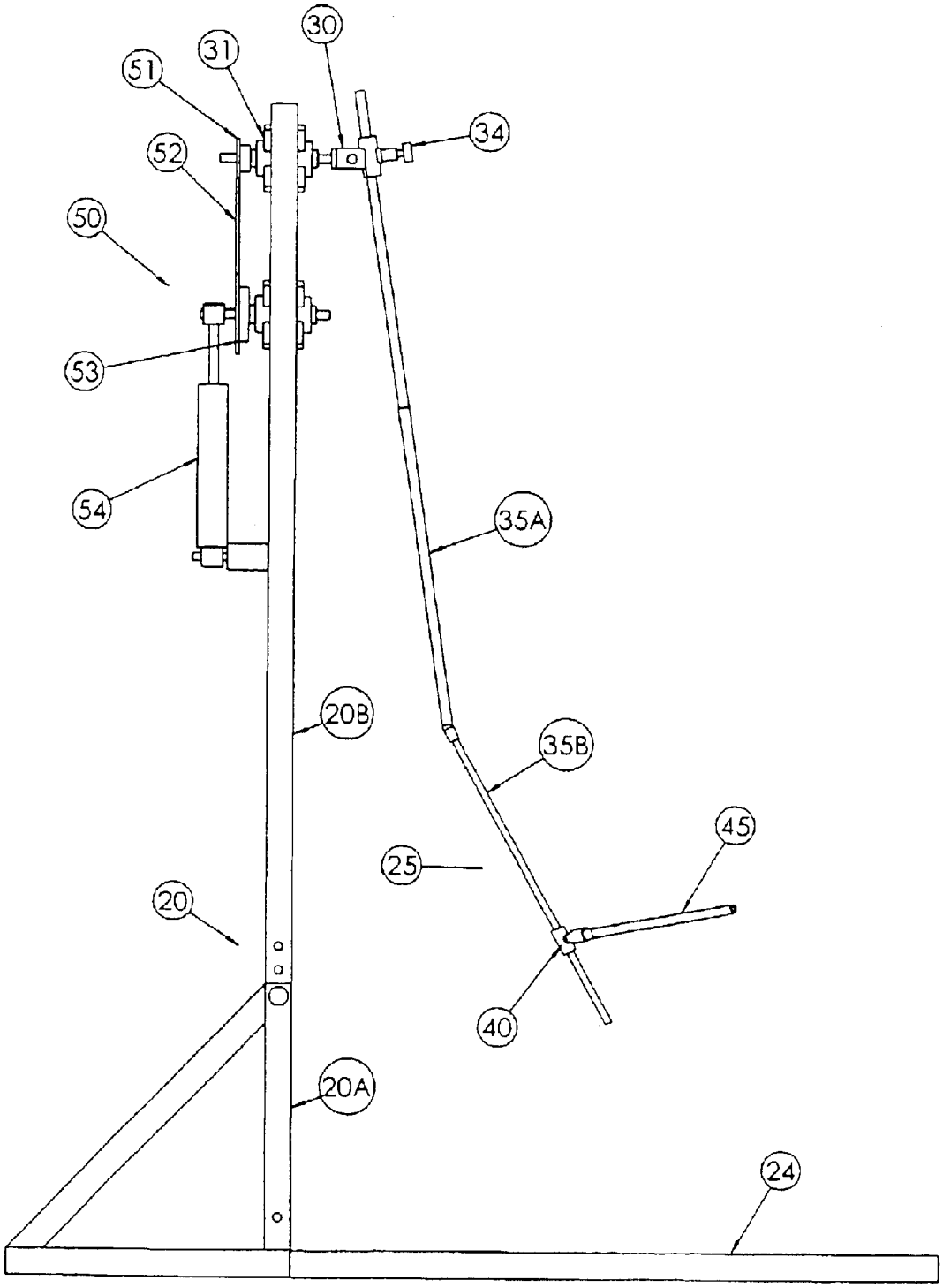
FIG. 1 is a side view of the first preferred embodiment of the GSC.

The GSC 10 is a device for practicing a sport swing and for exercising the specific muscle groups used throughout the range of motion of such a swing. The GSC 10 simulates a swing, as in the sport of golf, using a mechanical linkage 25. Most often, the mechanical linkage 25 is suspended from a vertical frame 20, with the mechanical linkage 25 rotatably attached to the frame 20 near the top of the frame 20 and hanging down towards, but not contacting, the floor (or the base platform 24). The bottom of the frame 20 may be attached to a platform 24 upon which a user would stand to make use of the mechanical linkage 25. The platform 24 would provide a broader base, making the frame 20 more stable, and would employ the user's weight to more firmly brace the frame 20 to the floor. To simulate a golf swing in a way that will distribute the resistance evenly throughout the swinging motion and that will not restrict the range of motion of the user, the mechanical linkage 25 includes at least six independent movement planes. In other words, in the preferred embodiment the mechanical linkage 25 comprises six free-moving joints. The mechanical linkage 25 is further comprised of an arm 35 and a handle 45. While the arm 35 often includes an upper portion which is essentially vertical (i.e. hanging down vertically from its connection to the frame 20), the arm 35 must have at least some portion, located at the bottom of the arm 35, which is not essentially vertical, but which instead projects forth towards the user at some angle which is typically greater than or equal to 90 degrees from the upper portion of the arm 35. In the preferred embodiment, the six movement planes are accomplished by the joint connection 30 between the mechanical linkage 25 (and more specifically, the arm 35) and the frame 20, the joint connector 40 between the arm 35 and the handle 45, and the ability of the handle 45 to rotate about its own center axis.

There are three basic configurations for the arm 35 of the mechanical linkage 25. In the first configuration, shown in FIGS. 1 and 2, the upper portion of the arm 35 is essentially vertical or angles away from the frame 20 and towards the user only slightly, while the lower portion of the arm 35 bends substantially away from the frame 20 and towards the user at an angle such that the bottom portion of the arm 35 is essentially horizontal (i.e. parallel to the floor or the platform 24). In the second configuration, shown in FIGS. 3, 4, and 5, the upper portion of the arm 35 is essentially vertical, although it may also angle towards the user, while the lower portion of the arm 35 bends substantially away from the frame 20 and towards the user at an angle greater than 90 degrees from the upper portion of arm 35, such that the lower portion of the arm 35 is angled downward towards the platform 24 (or the floor) where the user stands. In another configuration (not shown), the entire arm is angled downward from the joint 30 towards the platform 24 (or the floor) and outward away from the frame 20 and towards the user. This configuration, obviously, requires more room, since the entire arm 35 extends further away from the frame 20.

In addition to the mechanical linkage 25 used for simulating the golf swing, the GSC 10 may also include a resistance mechanism 50 so that it may be used for strength-resistance training. Any resistance mechanism 50 can be used in conjunction with the mechanical linkage 25, so long as it is able to apply resistance to the rotation of the mechanical linkage 25 (i.e. the resistance mechanism 50 must be configured to retard rotational motion). The resistance mechanism 50 may use hydraulic, electromagnetic, friction, weight, air/fan-blade, or any other type of resistance, including a magnetic disk, a friction clutch, a rotary actuator, or an hydraulic motor. The preferred resistance mechanism 50, however, employs hydraulic cylinders with pistons. A single two-way hydraulic cylinder may be used such that the piston encounters resistance both on the down stroke and the up stroke, or two or more one-way hydraulic cylinders may be used, such that each encounters resistance in only one stroke direction.

In the preferred embodiments, two one-way hydraulic cylinders are used. The hydraulic cylinders provide resistance in a linear fashion, however, so a train of mechanical elements must be used to translate the linear resistance into rotational resistance. There are several different mechanisms, some of which will be discussed in more detail below, through which this translation from linear to rotational resistance may occur, including pulley systems, lever-connecting-rod-rocker-bar systems, sprocket-chain-rocker-bar systems, and offset-lever systems. Thus, in the preferred embodiments, the resistance mechanism 50 is comprised of two hydraulic cylinders in conjunction with some sort of train of mechanical elements. Whichever type of resistance mechanism 50 is used, it must be designed so that it does not hamper, limit, or restrict a full swinging motion of the mechanical linkage 25.

Figure 2:
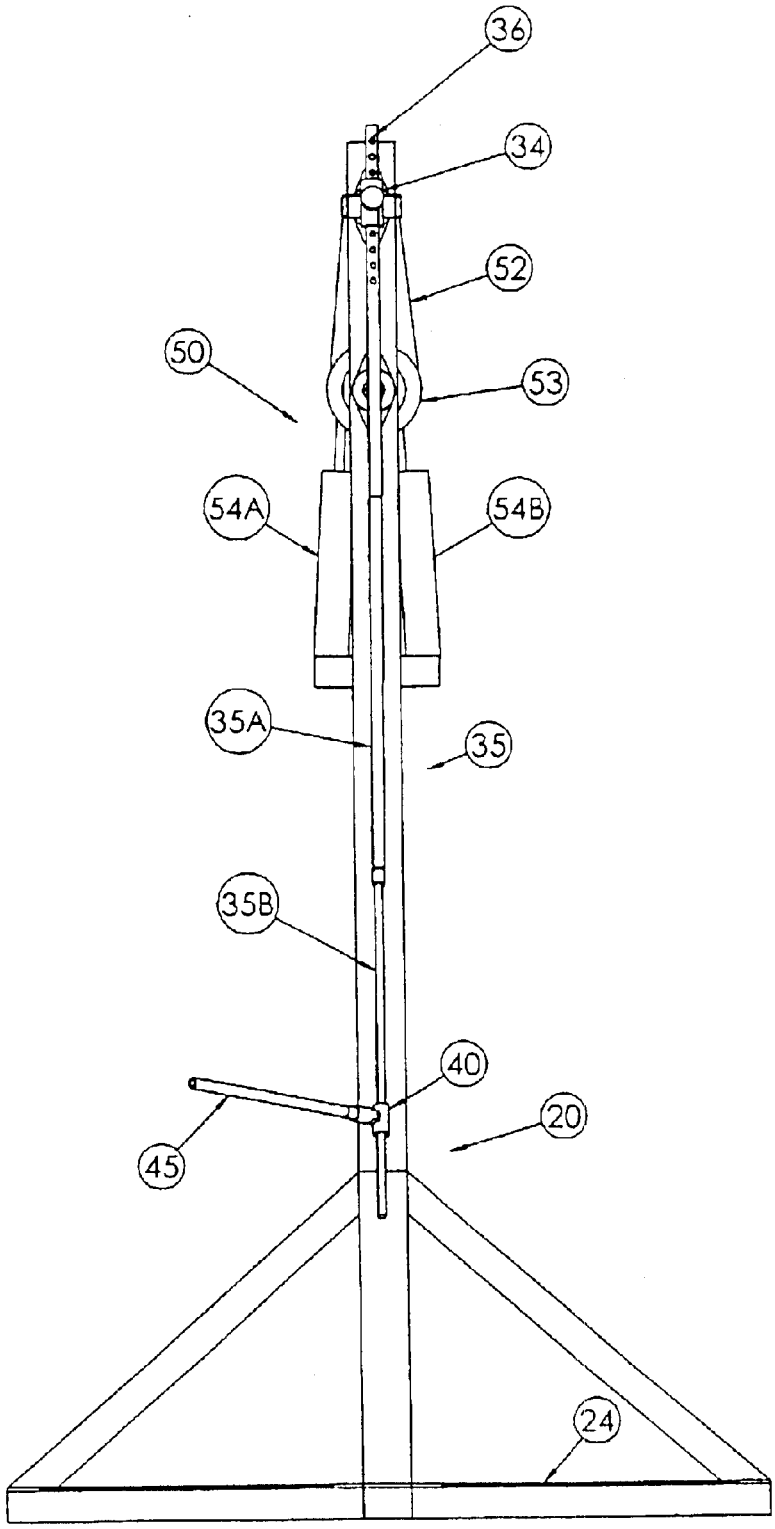
FIG. 2 is a front view of the first preferred embodiment of the GSC.

Turning now to the drawings of the preferred embodiments in more detail, the first preferred embodiment of the GSC 10 is shown in FIGS. 1 and 2. The GSC 10 is comprised of a frame 20, a base platform 24, a mechanical linkage 25, and a resistance mechanism 50. The frame 20 is rigidly attached and braced at its base to the platform 24, which is intended to rest upon the ground (providing a broader base in order to stabilize the GSC 10) and to provide a place for the user to stand while swinging the mechanical linkage 25. The frame 20 extends up vertically from the base platform 24. In this first preferred embodiment, the frame 20 is comprised of two elements: a braced frame sleeve 20*a*, that is sturdily anchored to the base platform 24, and a pole (or column) 20*b*, which slidably mates with the sleeve 20*a*. In this embodiment, the height of the frame 20 is adjustable by means of a pop-pin, which also acts to secure the mating of the pole 20*b* to the sleeve 20*a*. The sleeve 20*a* includes a pop-pin (i.e. a hole with a pin that fits securely through said hole), and the pole 20*b* has a vertical series of holes (sized so that the pop-pin fits securely) drilled along the bottom portion of its length. Thus, the height of the frame 20 may be adjusted by pulling out the pop-pin of frame sleeve 20*a*, sliding the pole 20*b* up or down in relation to the frame sleeve 20*a*, aligning the hole in the frame sleeve 20*a* with a hole in the pole 20*b* located at approximately the desired level, and reinserting the pop-pin of frame sleeve 20*a*. Typically, the height of the frame 20 is adjustable between approximately 75 inches and 87 inches. At or near the top of the pole 20*b* of the frame 20 is a hole 31. In the preferred embodiment, the hole 31 is lined with bearings, preferably pillow bearings, passes all the way through the frame 20, and is sized to securely receive the rotational shaft of joint 30 that links the mechanical linkage 25 to the resistance mechanism 50 while supporting the weight of the mechanical linkage via the frame 20.

The mechanical linkage 25 is further comprised of an arm 35 and a handle 45. In this embodiment, the arm is further comprised of two rods: an upper rod 35*a* and a lower rod 35*b*. One end of the lower rod 35*b* is rigidly attached to the bottom end of the upper rod 35*a* of the arm 35. The upper rod 35*a* is pivotally attached via joint 30 to the frame 20 (and on through the frame 20 to interact with the resistance mechanism 50), and hangs down essentially vertically (i.e. the upper rod 35*a* may hang straight down or may be slightly angled away from the frame as it descends) from joint 30. The lower rod 35*b* extends out from the bottom of the upper rod 35*a* in the direction away from the frame 20 at an angle between 90 degrees and 170 degrees from the upper rod 35*a*, preferably at an angle between 150 degrees and 170 degrees. Near the top end of the upper rod 35*a* is a vertical series of holes 36 which are used in conjunction with the pop-pin 34 of joint 30.

Figure 6:
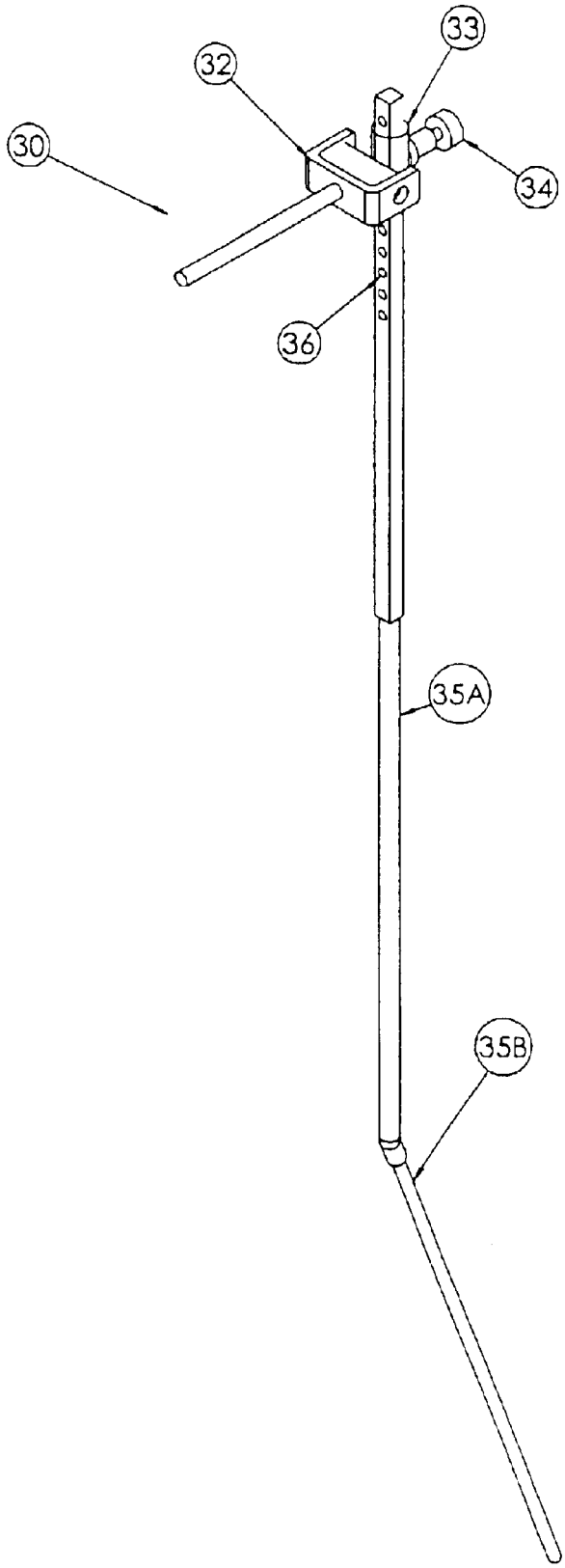
FIG. 6 is a perspective/isometric view of joint 30 from FIGS. 1 and 2.

The joint 30 rotatably (in two directions) connects the mechanical linkage 25 to the frame 20 near the top of frame 20, such that frame 20 supports the mechanical linkage 25, and the arm 35 of the mechanical linkage 25 hangs down from near the top of frame 20 towards, but not contacting, the platform 24. In resting position, the gap between the bottom of arm 35 and the platform 24 is approximately 10 inches in the preferred embodiment. More specifically, as shown in FIG. 6, joint 30 is comprised of a yoke 32 with a shaft and a T-shaped bushed housing 33 with a pop-pin 34. The T-shaped bushed housing 33 is essentially two cylinders rigidly joined together. The vertical cylinder of the bushed housing 33 is hollow, has the pop-pin 34, and is sized so that it acts as a sleeve to receive the top end of the upper rod 35*a*. Upper rod 35*a* of arm 35 is slidably mated within the vertical hollow cylinder (with pop-pin 34) of the T-shaped housing 33, with the pop-pin 34 securing the arm 35 within the T-shaped bushed housing 33. The horizontal cylinder of the bushed housing 33 fits within the bracket of the yoke 32 to form a depthwise hinge joint, such that the arm 35 may pivot towards the vertical frame 20 or away from the vertical frame 20. The shaft end of the yoke 32 fits securely into the pillow block bearings in hole 31 near the top of frame 20, such that the arm 35 may rotate laterally about the shaft of the yoke 32. Thus, joint 30 provides two separate degrees of rotation of the arm 35.

The height of the arm 35 may be adjusted by pulling out the pop-pin 34, sliding the upper arm 35*a* up or down within the T-shaped bushed housing 33, and releasing the pop-pin 34 into a hole 36 in the upper arm 35*a* at the appropriate height. When the arm 35 is secured within the T-shaped bushed housing 33, then the arm 35 hangs down from the joint 30, which is supported by frame 20, and the upper arm 35*a* is essentially vertical (i.e. approximately parallel to the pole 20*b* of frame 20, or angling slightly away from pole 20*b* as it descends) while the lower arm 35*b* extends out from the bottom end of the upper rod 35*a* at an angle preferably between 150 degrees and 170 degrees from the upper rod 35*a*, away from the pole 20*b* of the frame 20 (towards the user). Joint 30, which rotatably (pivotally) connects the arm 35 to the top of frame 20, allows the arm to rotate laterally (i.e. left-to-right) with respect to the frame 20 (and the user) and to pivot depthwise (i.e. towards and away) with respect to the frame 20 (and the user). Thus, the arm 35 may rotate in a plane approximately parallel to the frame 20 and may pivot in a plane approximately perpendicular to the frame 20.

Figure 7A:
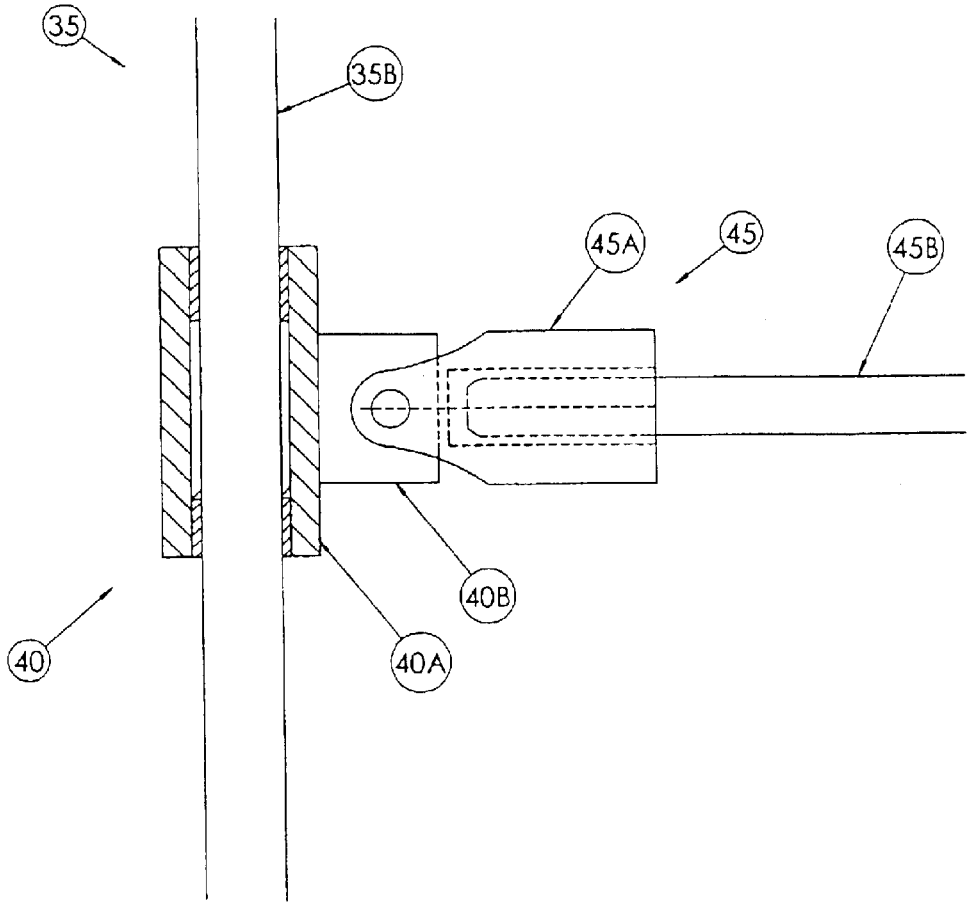
FIGS. 7A and 7B are cross-section views of the connector 40 about the lower rod of arm 35 pivotally attached to the rotatable handle 45.

The handle 45 is rotatably, slidably, and pivotally attached to the lower rod 35*b* of the arm 35 using connector 40. Connector 40, shown in more detail in FIG. 7A, is comprised of a bushed housing 40*a* fitted about the lower rod 35*b* of arm 35, with a pivot 40*b* rigidly attached to the outside of the bushed housing 40*a*. The bushed housing 40*a* is a hollow cylinder with bearings, preferably self-lubricating bearings/bushings such as garlock bearings, along the inside surface. The bushed housing 40*a* fits securely around the lower rod 35*b* and, due to the bearings, may slide along the length of the lower rod 35*b* and may rotate about the lower rod 35*b* (i.e. two degrees of motion). One end of the pivot 40*b* is rigidly attached to the outer surface of the bushed housing 40*a*, while the other end of the pivot 40*b* is attached to handle 45, such that handle 45 may pivot with respect to the bushed housing 40*a*. In the preferred embodiment, the pivoting hinge 40*b* is half of a universal joint.

Figure 7B:
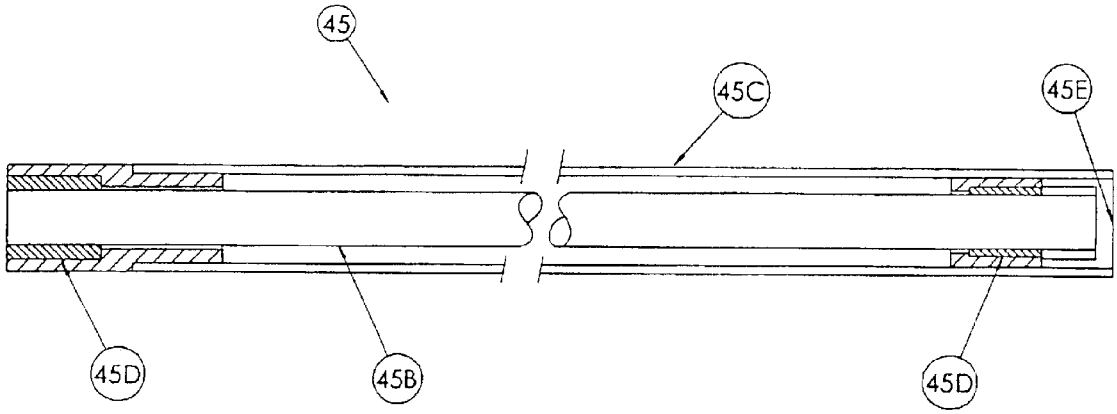

Furthermore, the handle 45, shown in FIGS. 7A and 7B, also may rotate about its own center axis. The handle 45, in this preferred embodiment, is further comprised of an end cap 45*a*, an inner rod 45*b*, an outer sleeve casing 45*c*, bearings 45*d*, and an end collar 45*e*. The handle 45, when assembled, resembles the handle of a golf club. The end cap 45*a* is pivotally attached to the bushed housing 40*a* of connector 40. The end cap 45*a* has a pivot point attachment on one end and extends into a hollow cylinder. One end of the inner rod 45*b* is inserted inside the hollow cylindrical end of the end cap 45*a* along the centerline of the cylinder of the end cap 45*a* and is rigidly attached to the end cap 45*a*. The inner rod 45*b* has a smaller outside diameter than the inner surface diameter of the hollow cylinder of the end cap 45*a*, such that there is clearance space between the inner rod 45*b* and the end cap 45*a*. The outer sleeve casing 45*c* is a hollow cylinder with an inner surface diameter which is larger than the outer diameter of the inner rod 45*b* and with an outer surface diameter that is smaller than the inner surface diameter of the hollow cylinder of the end cap 45*a*. The bearings 45*d* are located in the space between the inner rod 45*b* and the inner surface of the outer sleeve casing 45*c* and securely contact both the inner rod 45*b* and the outer sleeve casing 45*c*. The end collar 45*e* attaches rigidly to, for example by screwing onto, the inner rod 45*b*, and has an outer surface diameter which is at least as large as the outer surface diameter of the outer sleeve casing 45*c*. Thus, when assembled, the handle 45 is pivotally attached to the bushed housing 40*a* of connector 40 (and thereby to the lower rod 35*b* of arm 35) via the end cap 45*a*. The outer sleeve casing 45*c* is the gripping surface for the user which rotates with respect to the centerline of the handle 45 about the bearings 45*d* resting upon inner rod 45*b*. The outer sleeve casing 45*c* is held in place about the inner rod 45*b* with the end cap 45*a* at one end and the end collar 45*e* at the other end. The preferred embodiment uses self lubricating bearings/bushings, and the surfaces which contact the bearings are hard and smooth, ensuring smooth rotation.

Figure 10:
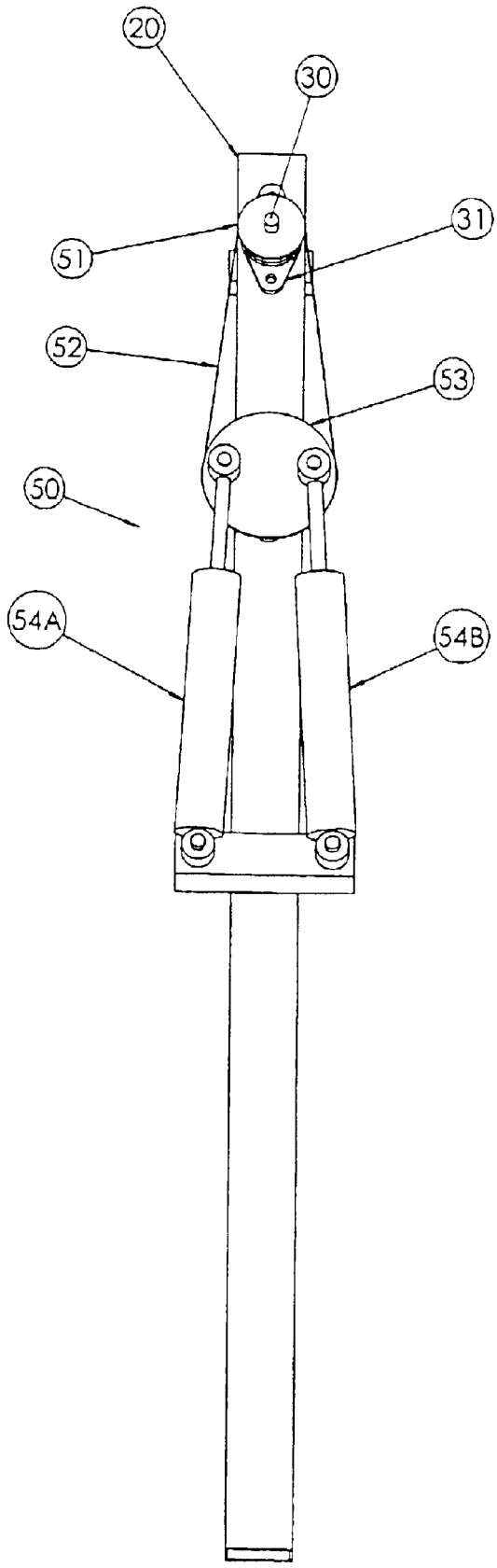
FIG. 10 is a rear view of the pulley-hydraulic cylinder resistance mechanism.

In this preferred embodiment, the resistance mechanism 50 (shown in FIG. 10) is located on the opposite side of the frame 20 from the mechanical linkage 25 and is comprised of a pulley system with hydraulic cylinder resistance. The shaft of joint 30 extends through the hole with pillow block bearings 31 in the frame 20 and out the other side to interact with the resistance mechanism 50. The upper pulley wheel 51 is rigidly attached at its center to the shaft of joint 30, such that it rotates in unison with the shaft of joint 30. The upper pulley wheel 51 is a sprocket with teeth. The lower pulley wheel 53 is also a sprocket with teeth. The lower pulley wheel 53 is rotatably mounted to the frame 20 some distance below the upper pulley wheel 51 (i.e. an axis is rigidly attached to the frame 20 and the lower pulley wheel 53 is rotatably centered on said axis). A chain 52, which is formed into an elliptical loop, connects the upper pulley wheel 51 to the lower pulley wheel 53, with the teeth of the upper pulley wheel 51 and the lower pulley wheel 53 catching the links of the chain 52 so that motion is transmitted between the upper pulley wheel 51 and the lower pulley wheel 53 (and vice versa) via the chain 52.

Typically, the lower pulley wheel 53 is significantly larger in size (diameter) than the upper pulley wheel 51, so that a large rotation of the arm 35 (and thereby the upper pulley wheel 51 via the shaft of joint 30) results in only a slight rotation of the lower pulley wheel 53. This is particularly important in this type of embodiment since a full swing range should not rotate the lower pulley wheel 53 more than 180 degrees in order to effectively translate the rotational motion into linear motion of the pistons in the hydraulic cylinders 54*a* and 54*b*. Typically, the ratio of size between lower pulley wheel 53 and upper pulley wheel 51 is between 1.75–2.5 to 1; in the preferred embodiment, the ratio is approximately 2 to 1. The top of the pistons of both one-way hydraulic cylinders 54*a* and 54*b* are rotatably attached to a face of lower pulley wheel 53 (equidistantly spaced from the axis of rotation, one on each side when the GSC 10 is at rest), while the exterior of the hydraulic cylinders 54*a* and 54*b* are rotatably mounted upon the frame 20 directly below the connection of the pistons to the lower pulley wheel 53 when the GSC 10 is at rest. In this initial rest position, both pistons of both hydraulic cylinders 54*a* and 54*b* extend up approximately half of their stroke length. The hydraulic cylinders are mounted a distance below the lower pulley wheel 53 relative to the length of the piston stroke, and the piston stroke must be sufficiently long to span the maximum up/down displacement caused by rotation of the lower pulley wheel 53 during a full swing (i.e. approximately based on the diameter of the lower pulley wheel 53). More specifically, the entire resistance mechanism 50 is mounted to the pole 20*b*. These rotatable connections allow the hydraulic cylinders 54*a* and 54*b* to maintain proper linear alignment as the lower pulley wheel 53 rotates.

Thus, when the lower pulley wheel 53 rotates, one of the pistons of the hydraulic cylinders 54 is pushed down in compression (experiencing resistance), while the other piston of the other hydraulic cylinder 54 is pulled up (with no resistance). If the lower pulley wheel 53 rotates the other way, the opposite effect occurs. Thus, the two hydraulic cylinder 54*a* and 54*b* provide resistance to the rotation of the lower pulley wheel 53 no matter which way it rotates, and this resistance is passed up through the chain 52 to the upper pulley wheel 51 and through the shaft of joint 30 to the arm 35. The amount of resistance is typically adjustable by altering the opening size of a valve in the hydraulic cylinders 54*a* and 54*b* via a knob, for example, with a larger opening reducing the resistance while a smaller opening increases resistance.

The frame 20 and the base platform 24 should be made of a strong and durable material so that they can effectively support the weight of the entire GSC 10. In the preferred embodiment, the frame 20 is made of steel and base platform 24 is made of a steel frame with a plywood top coated with a rubber gripping surface. The arm 35 should be made of a strong, durable, and lightweight material, and the lower rod 35*b* of the arm 35 should also have a hard, smooth surface for the bearing contact of the bushed housing 40*a* of connector 40, so that the bearings may slide and rotate smoothly along the surface without catching. In the preferred embodiment, the upper rod 35*a* of the arm 35 is made of steel tubing, while the lower rod 35*b* is made of steel, with a hard chrome surface finish. Similarly, the bearing surface on the inside of the outer sleeve cover 45*c* and the bearing surface on the outside of the inner rod 45*b* of the handle 45 should both be hard and smooth. Finally, the bearing surface on the shaft of joint 30 should also be hard and smooth. Preferably, there will be little or no resistance in the mechanical linkage 25 itself, such that all resistance is evenly and smoothly applied by the resistance mechanism 50. This allows for a smooth, fluid swinging motion, without any jerking or catching that could cause injury, and reduces wear to improve durability. In the preferred embodiment all bearings/bushings are self-lubricating, hard, and tough. This ensures that they are durable enough to work effectively over the life of the GSC. In the preferred embodiment, garlock bushings are used throughout. But, even with the self-lubricating bearings/bushings, additional lubrication is often advisable.

Figure 3:
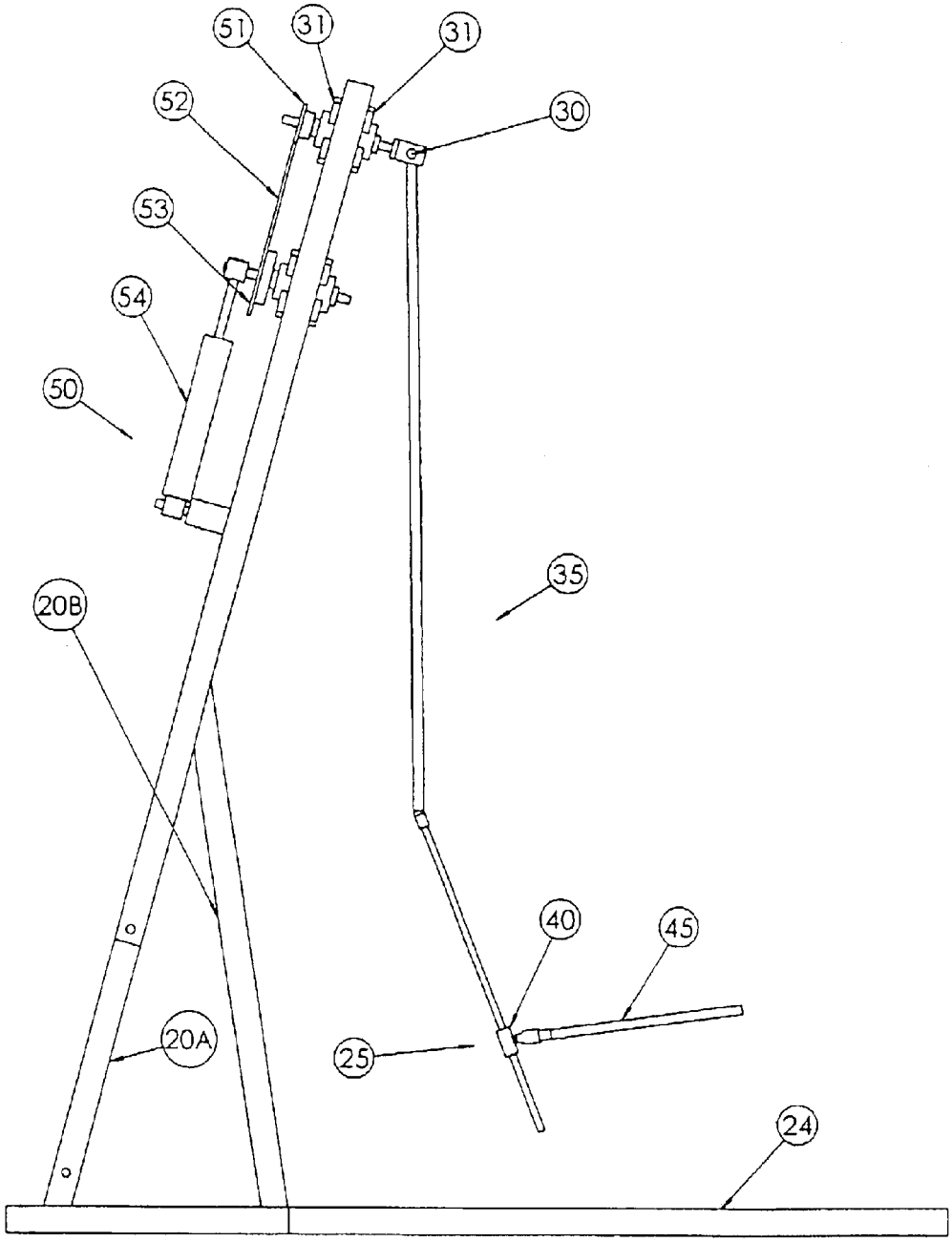
FIG. 3 is a side view of the second preferred embodiment of the GSC.
Figure 4:
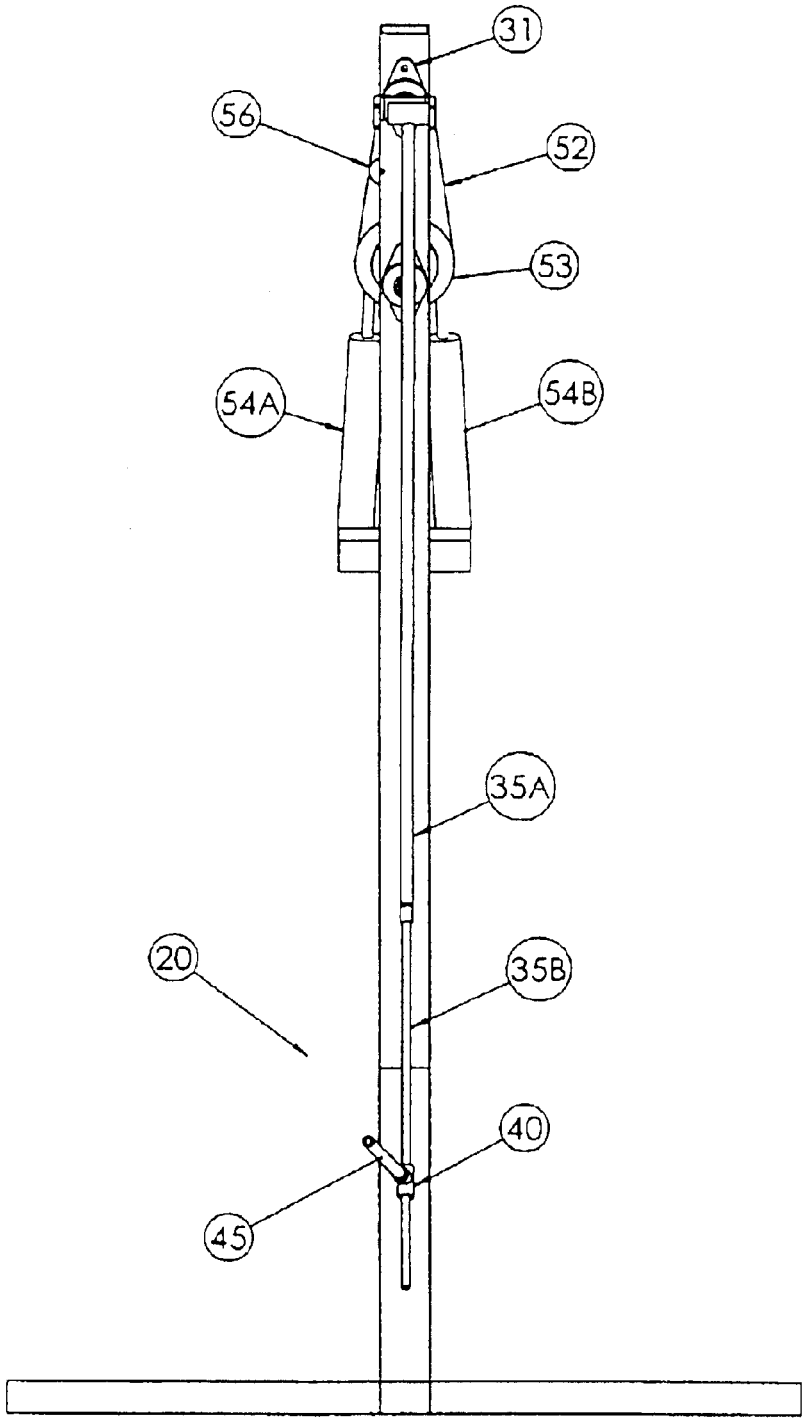
FIG. 4 is a front view of the second preferred embodiment of the GSC.
Figure 5:
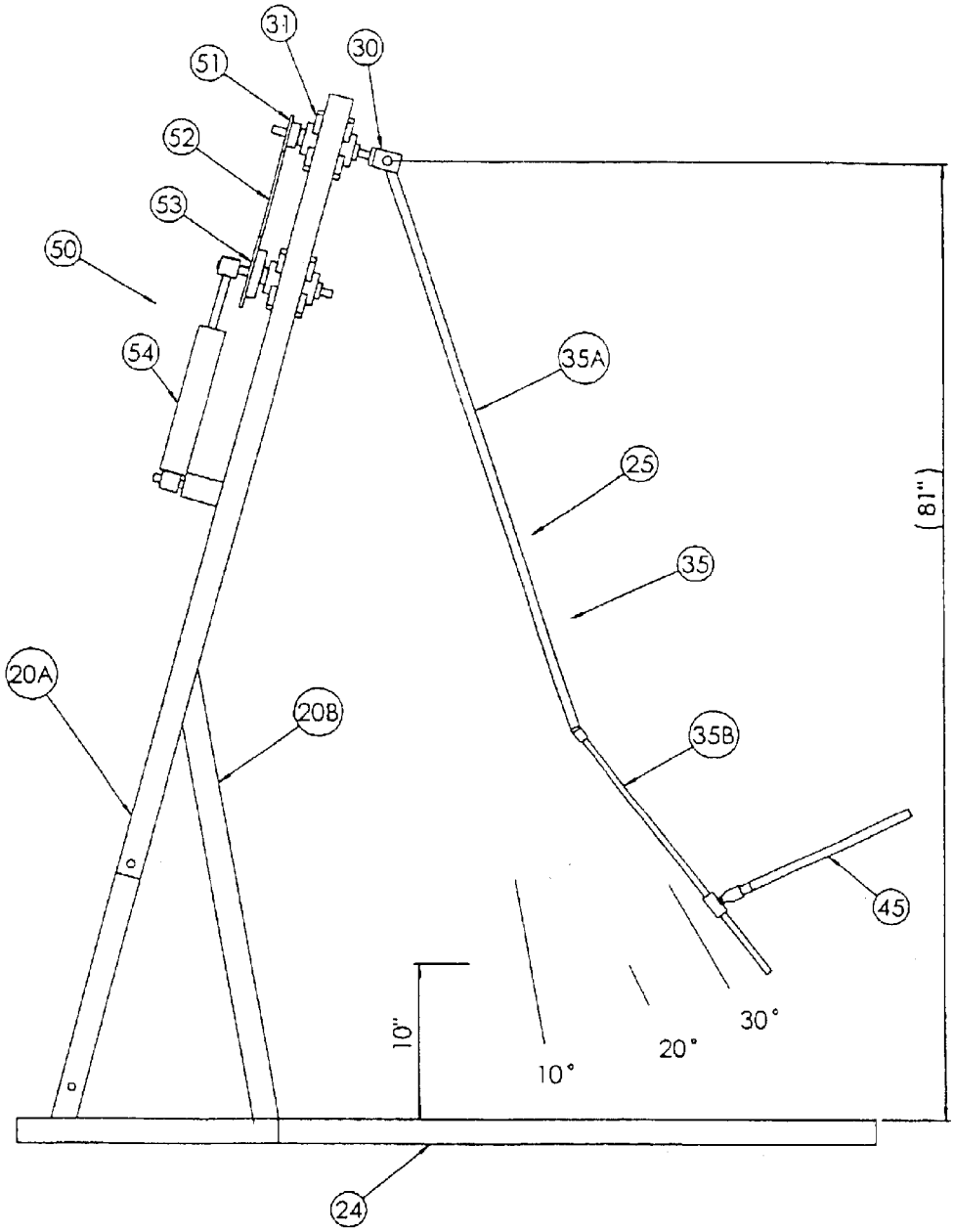
FIG. 5 is a side view of the second preferred embodiment of the GSC illustrating the preferred dimensions and angles.

The second preferred embodiment of the GSC 10 is shown in FIGS. 3 and 4. The GSC 10 is comprised of a frame 20, a base platform 24, a mechanical linkage 25, and a resistance mechanism 50. The frame 20 is rigidly attached and braced at its base to the platform 24, which is intended to rest upon the ground (providing a broader base in order to stabilize the GSC 10) and to provide a place for the user to stand while swinging the mechanical linkage 25. The frame 20 is attached at one end of the platform 24 and extends up from the base platform 24. In this preferred embodiment, the frame 20 is comprised of an angled pole (or column) 20*a* braced by a crossbar 20*b*, which supports the pole 20*a* as it leans over the platform 24. The pole 20*a* of the frame 20 does not project straight up; rather, the pole 20*a* angles towards the portion of the platform 24 upon which the user will stand as it rises vertically. This configuration provides additional clearance between the frame 20 and the mechanical linkage 25. The height of the pole 20*a* is not adjustable, but is fixed. Typically, the overall height of the frame is approximately 75 inches to 87 inches. In the preferred embodiment, the frame 20 is approximately 81 inches tall. At or near the top of the pole 20*a* of the frame 20 is a hole with pillow block bearings 31 passing all the way through the frame 20 and sized to securely receive the rotational shaft of joint 30 that links the mechanical linkage 25 to the resistance mechanism 50.

Figure 8:
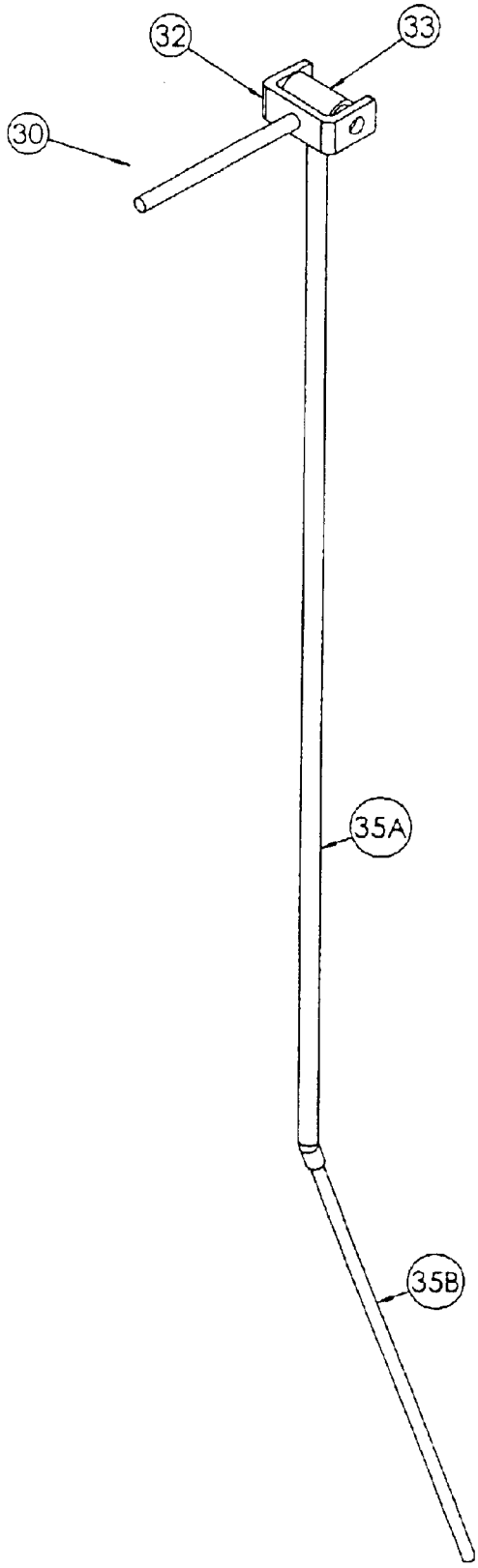
FIG. 8 is a perspective/isometric view of joint 30 from FIGS. 3 and 4.

The mechanical linkage 25 is further comprised of an arm 35 and a handle 45. In this embodiment, the arm is further comprised of two rods: an upper rod 35*a* and a lower rod 35*b*. One end of the lower rod 35*b* is rigidly attached to the bottom end of the upper rod 35*a* of the arm 35. The upper rod 35*a* is pivotally attached via joint 30 to the frame 20 and on through to interact with the resistance mechanism 50, and hangs down essentially vertically from joint 30. Alternatively, the upper rod 35*a* could angle somewhat away from the frame 20 (towards the user) down its length rather than hanging essentially vertical. The lower rod 35*b* extends out from the bottom of the upper rod 35*a* in the direction away from the frame 20 (towards the user) typically at some angle greater than 90 degrees but less than 180 degrees from the upper rod 35*a*, such that the lower rod 35*b* is not horizontal or past horizontal/angled upwards, but declines as it extends outward away from the frame 20. In the preferred embodiment, the lower rod 35*b* extends out from the upper rod 35*a* at an angle between 155 degrees to 160 degrees, as this angle has proven most comfortable to users. The top of the upper rod 35*a* is rigidly attached to a cylindrical bushed housing 33 that forms part of the joint 30, as shown in FIG. 8.

The joint 30 rotatably (in two directions) connects the mechanical linkage 25 to the frame 20 near the top of frame 20, such that frame 20 supports the mechanical linkage 25, and the arm 35 of the mechanical linkage 25 hangs down from near the top of frame 20 towards but not contacting the base platform 24. More specifically, as shown in FIG. 8, joint 30 is comprised of a yoke 32 with a shaft and a cylindrical bushed housing 33. The cylindrical bushed housing 33 fits within the bracket of the yoke 32 to form a depthwise hinge joint, such that the arm 35, which is rigidly attached to the cylindrical bushed housing 33, may pivot towards the frame 20 or away from the frame 20. The shaft end of the yoke 32 fits securely into the pillow block bearings in hole 31 near the top of frame 20, such that the arm 35 may rotate laterally (left-to-right in relation to the frame 20 and the user) about the shaft of the yoke 32. Thus, the arm 35 may rotate in a plane approximately parallel to frame 20 and may pivot in a plane approximately perpendicular to frame 20.

When the arm 35 is secured within the yoke 32 via the cylindrical bushed housing 33, the arm 35 hangs down from the joint 30, which is supported by frame 20, above but not contacting the platform 24. In the preferred embodiment, the gap between the bottom of arm 35 and the base platform 24 (in resting mode) is approximately 10 inches. The upper arm 35*a* hangs approximately vertical while the lower arm 35*b* extends out at a declining angle away from the frame 20 (such that it points towards the platform 24). Joint 30, which rotatably (pivotally) connects the arm 35 to the top of frame 20, allows the arm to rotate laterally (i.e. left-to-right) with respect to the frame 20 (and the user) and to pivot depthwise (i.e. towards and away) with respect to the frame 20 (and the user).

The handle 45 is rotatably, slidably, and pivotally attached to the lower rod 35*b* of the arm 35 using connector 40. Connector 40, shown in more detail in FIG. 7A, is comprised of a bushed housing 40*a*, fitted about the lower rod 35*b* of arm 35, with a pivot 40*b* rigidly attached to the outside of the bushed housing 40*a*. The bushed housing 40*a* is a hollow cylinder with bearings, such as garlock bearings, along the inside surface. The bushed housing fits securely (snugly) around the lower rod 35*b* and, due to the bearings, may slide along the length of the lower rod 35*b* and may rotate about the lower rod 35*b* (i.e. two degrees of motion). One end of the pivot 40*b* is rigidly attached to the outer surface of the bushed housing 40*a*, while the other end of the pivot 40*b* is attached to handle 45, such that handle 45 may pivot with respect to the bushed housing 40*a*. In the preferred embodiment, the pivoting hinge 40*b* is half of an universal joint.

Furthermore, the handle 45 also may rotate about its own center axis. The handle, in this preferred embodiment, is further comprised of an end cap 45*a*, an inner rod 45*b*, an outer sleeve casing 45*c*, bearings 45*d*, and an end collar 45*e*. The handle 45, when assembled, resembles the handle of a golf club. The end cap 45*a* is pivotally attached to the bushed housing 40*a* of connector 40. The end cap 45*a* has a pivot point attachment on one end and extends into a hollow cylinder. One end of the inner rod 45*b* is inserted inside the hollow cylindrical end of the end cap 45*a* along the centerline of the cylinder of the end cap 45*a* and is rigidly attached to the end cap 45*a*. The inner rod 45*b* has a smaller outside diameter than the inner surface diameter of the hollow cylinder of the end cap 45*a*, such that there is clearance space between the inner rod 45*b* and the end cap 45*a*. The outer sleeve casing 45*c* is a hollow cylinder with an inner surface diameter which is larger than the outer diameter of the inner rod 45*b* and with an outer surface diameter that is smaller than the inner surface diameter of the hollow cylinder of the end cap 45*a*. The bearings 45*d* are located in the space between the inner rod 45*b* and the inner surface of the outer sleeve casing 45*c* and securely contact both the inner rod 45*b* and the outer sleeve casing 45*c*. The end collar 45*e* attaches rigidly to, for example by screwing onto, the inner rod 45*b*, and has an outer surface diameter which is at least as large as the outer surface diameter of the outer sleeve casing 45*c*. Thus, when assembled, the handle 45 is pivotally attached to the bushed housing 40*a* of connector 40 (and thereby to the lower rod 35*b* of arm 35)

via the end cap 45*a*. The outer sleeve casing 45*c* is the gripping surface for the user which rotates with respect to the centerline of the handle 45 about the bearings 45*d* resting upon inner rod 45*b*. The outer sleeve casing 45*c* is held in place about the inner rod 45*b* with the end cap 45*a* at one end and the end collar 45*e* at the other end. The preferred embodiment uses self lubricating bearings/bushings, and the surfaces which the bearings contact are hard and smooth.

In this preferred embodiment, the resistance mechanism 50 (shown in FIG. 10) is located on the opposite side of the frame 20 from the mechanical linkage 25 and is comprised of a pulley system with hydraulic cylinder resistance. The shaft of joint 30 extends through the hole with pillow block bearings 31 in the frame 20 and out the other side to interact with the resistance mechanism 50. The upper pulley wheel 51 is rigidly attached at its center to the shaft of joint 30, such that it rotates in unison with the shaft of joint 30. The upper pulley wheel 51 is a sprocket with teeth. The lower pulley wheel 53 is also a sprocket with teeth. The lower pulley wheel 53 is rotatably mounted to the frame 20 (i.e. the axis of rotation of the lower pulley wheel 53 is rigidly attached to the frame 20 such that lower pulley wheel 53 rotates about the axis) some distance below the upper pulley wheel 51. A chain 52, which is formed into an elliptical loop, connects the upper pulley wheel 51 to the lower pulley wheel 53, with the teeth of the upper pulley wheel 51 and the lower pulley wheel 53 catching the links of the chain 52 so that motion is transmitted between the upper pulley wheel 51 and the lower pulley wheel 53 (and vice versa) via the chain 52. A sprocket 56 is rotatably attached to the frame 20 between the upper pulley wheel 51 and the lower pulley wheel 53, and its position may be altered incrementally and then fixed. The sprocket 56 has teeth and is to be positioned so that it meshes with the chain 52. The sprocket is used to maintain a tight fit of the chain 52 between the upper pulley wheel 51 and the lower pulley wheel 53. If the chain 52 begins to loosen over time, the user may extend the sprocket 56 to take up the slack.

Typically, the lower pulley wheel 53 is significantly larger in size (diameter) than the upper pulley wheel 51, so that a large rotation of the arm 35 and thereby the upper pulley wheel 51 via the shaft of joint 30 results in only a slight rotation of the lower pulley wheel 53. This is particularly important in this type of embodiment since a full swing range should not rotate the lower pulley wheel 53 more than 180 degrees in order to effectively translate the rotational motion into linear motion of the pistons in the hydraulic cylinders 54*a* and 54*b*. Typically, the ratio of size between lower pulley wheel 53 and upper pulley wheel 51 is between 1.75–2.5 to 1; in the preferred embodiment, the ratio is approximately 2 to 1. The top of the pistons of both one-way hydraulic cylinders 54*a* and 54*b* are rotatably attached to a face of lower pulley wheel 53 equidistantly spaced about the axis of rotation in resting mode, with one on each side, while the exterior of the hydraulic cylinders 54*a* and 54*b* are rotatably mounted upon the frame 20 directly below the connection of the pistons to the lower pulley wheel 53 when the GSC 10 is at rest. In this initial rest position, both pistons of both hydraulic cylinders 54*a* and 54*b* extend up approximately half of their stroke length. The hydraulic cylinders are mounted a distance below the lower pulley wheel 53 relative to the length of the piston stroke, and the piston stroke must be sufficiently long to span the maximum up/down displacement caused by rotation of the lower pulley wheel 53 during a full swing (i.e. approximately based on the diameter of the lower pulley wheel 53). These rotatable connections allow the hydraulic cylinders 54 to orient themselves as the lower pulley wheel 53 rotates.

Thus, when the lower pulley wheel 53 rotates, one of the pistons of the hydraulic cylinders 54 is pushed down in compression (experiencing resistance), while the other piston of the other hydraulic cylinder 54 is pulled up (with no resistance). If the lower pulley wheel 53 rotates the other way, the opposite effect occurs. Thus, the two hydraulic cylinder 54*a* and 54*b* provide resistance to the rotation of the lower pulley wheel 53 no matter which way it rotates, and this resistance is passed up through the chain 52 to the upper pulley wheel 51 and through the shaft of joint 30 to the arm 35. The amount of resistance is typically adjustable by altering the opening size of a valve in the hydraulic cylinders 54*a* and 54*b* via a knob, for example, with a larger opening reducing the resistance while a smaller opening increases resistance.

The frame 20 and the base platform 24 should be made of a strong and durable material so that they can effectively support the weight of the entire GSC 10. In the preferred embodiment, the frame 20 is made of steel and base platform 24 is made of steel framing with a plywood top coated with a rubber gripping surface. The arm 35 should be made of a strong, durable, and lightweight material, and the lower rod 35*b* of the arm 35 should also have a hard, smooth surface for the bearing contact of the bushed housing of connector 40, so that the bearings may slide and rotate smoothly along the surface without catching. In the preferred embodiment, the upper rod 35*a* of the arm 35 is made of steel tubing, while the lower rod 35*b* is made of steel, with a hard chrome surface finish. Similarly, the bearing surface on the inside of the outer sleeve cover 45*c* and the bearing surface on the outside of the inner rod 45*b* of the handle 45 should both be hard and smooth. Finally, the bearing surface on the shaft of joint 30 should also be hard and smooth. Preferably, there will be little or no resistance in the mechanical linkage 25 itself, such that all resistance is evenly and smoothly applied by the resistance mechanism 50. This allows for a smooth, fluid swinging motion, without any jerking or catching that could cause injury, and reduces wear to improve durability. In the preferred embodiment all bearings/bushings are self-lubricating, hard, and tough. This ensures that they are durable enough to work effectively over the life of the GSC. In the preferred embodiment, garlock bushings are used throughout. But, even with the self-lubricating bearings/bushings, additional lubrication is advisable.

Figure 9:
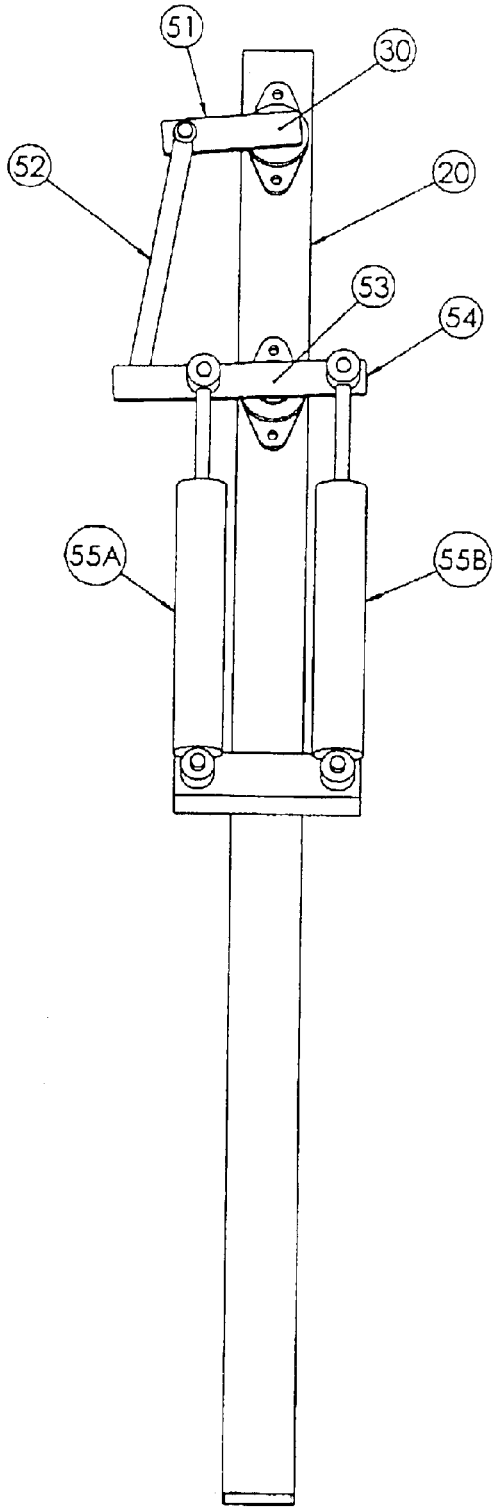
FIG. 9 is a rear view of the lever connecting rod rocker bar resistance mechanism.

There are additional preferred embodiments of the resistance mechanism 50 (to be used in conjunction with a frame 20 and a mechanical linkage 25 as described in either of the above preferred embodiments) which would also effectively translate the rotational input of the shaft of joint 30 into a linear motion for the hydraulic cylinders. FIG. 9 illustrates a lever-connecting-rod-rocker bar resistance mechanism 50. One end of a lever 51 is rigidly attached to the end of the shaft of joint 30 so that the lever 51 extends out from the shaft and rotates in unison with the shaft. Rigidly attached to the frame some distance below the lever 51 is a pivot point 53. A rocker bar 54 is rotatably attached to the pivot point 53, such that the rocker bar 54 may rotate about the pivot point 53. The rocker bar 54 extends out in both horizontal directions from the pivot point 53 (when GSC 10 is at rest), with one side of the rocker bar 54 extending out farther from the pivot point 53 than the other side of the rocker bar 54. This longer, extended end of the rocker bar 54 extends out farther from the pivot point 53 than the lever 51 does from the shaft of joint 30. Thus, the rocker bar 54 is eccentrically located about the pivot point 53. Typically, the ratio between the rocker bar 54 and the lever 51 is between 1.75–2.5 to 1; in the preferred embodiment, the ratio is approximately 2 to 1.

The hydraulic cylinders 55*a* and 55*b* are located beneath the rocker bar 54 and the pivot point 53, one on each side of the pivot point 53 equidistantly spaced, and the exterior of both hydraulic cylinders 55 are rotatably attached to the frame 20. The pistons of each of the hydraulic cylinders 55*a* and 55*b* extend up to rotatably attach to a face of the rocker bar 54, with the piston of the hydraulic cylinder 55 on each side of the pivot point 53 attaching to the rocker bar at a point directly above its hydraulic cylinder 55 (in resting position, i.e. when the rocker bar is horizontal) on the same side of the pivot point 53. In this initial rest position, both pistons of both hydraulic cylinders 54*a* and 54*b* extend up approximately half of their stroke length. The hydraulic cylinders are mounted a distance below the rocker bar 54 relative to the length of the piston stroke, and the piston stroke must be sufficiently long to span the maximum up/down displacement caused by rotation of the rocker bar 54 during a full swing (i.e. approximately based on the rotational diameter of the rocker bar 54).

Finally, a connecting rod 52 links the lever 51 to the rocker bar 54. One end of the connecting rod 52 is rotatably attached to the outer face of the lever 51 near the free end of the lever 51 away from the shaft of joint 30, while the other end of the connecting rod 52 is rotatably attached to the inner face of the rocker bar 54 near the end of the rocker bar 54 which extends beyond the rotatable attachment of the piston of the hydraulic cylinder 55 and is eccentrically extended. Both the free end of the lever 51 and the longer, extended end of the rocker bar 54 should be located on the same side of the frame 20 (and the pivot point 53 and the shaft of joint 30) in the initial, resting position, with both the lever 51 and the rocker bar 54 approximately horizontal, and with the free end of the lever 51 extending out in the same horizontal direction as the longer, extended end of the rocker bar 54.

Figure 11:
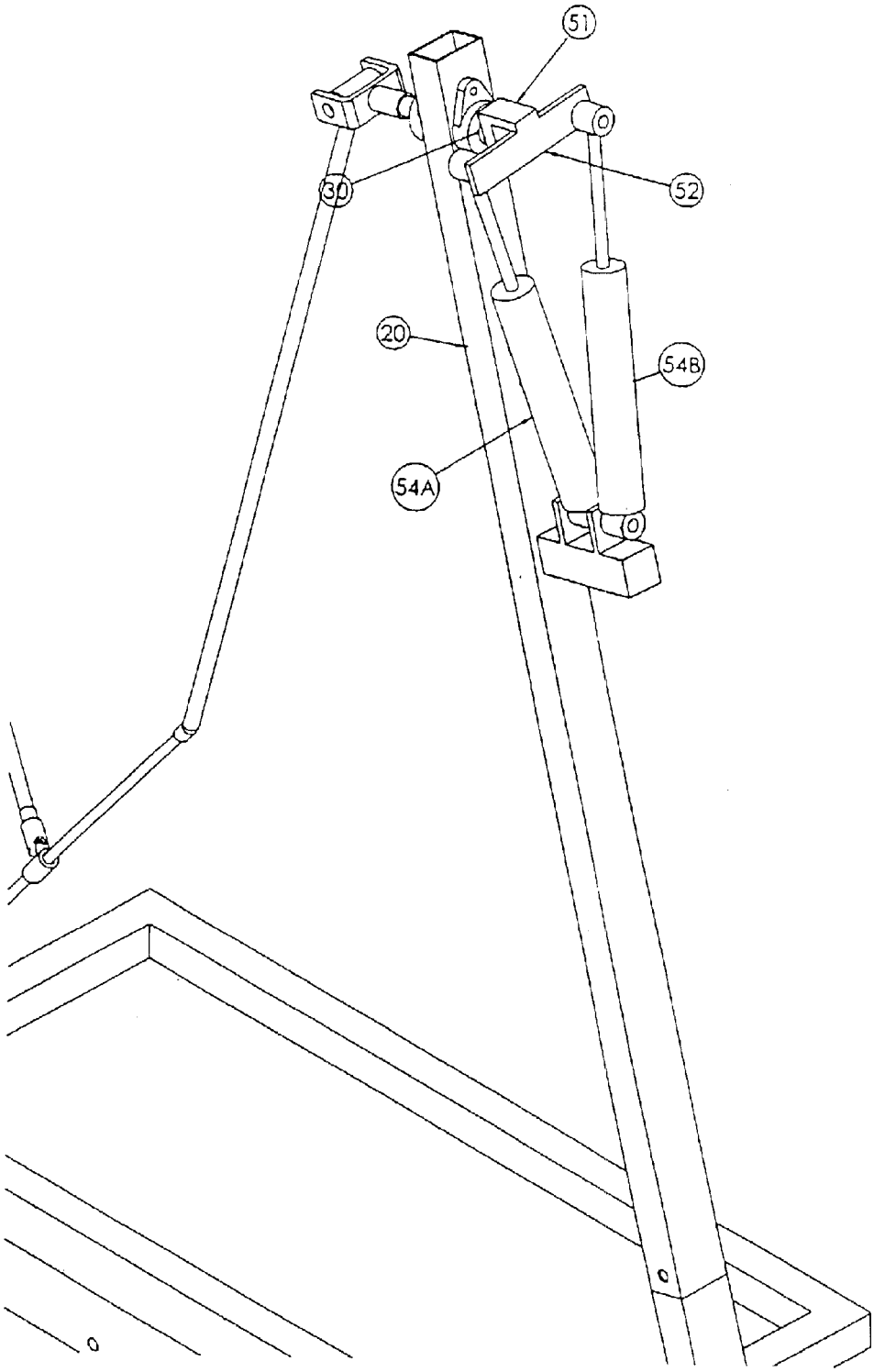
FIG. 11 is a perspective view.
Figure 12:
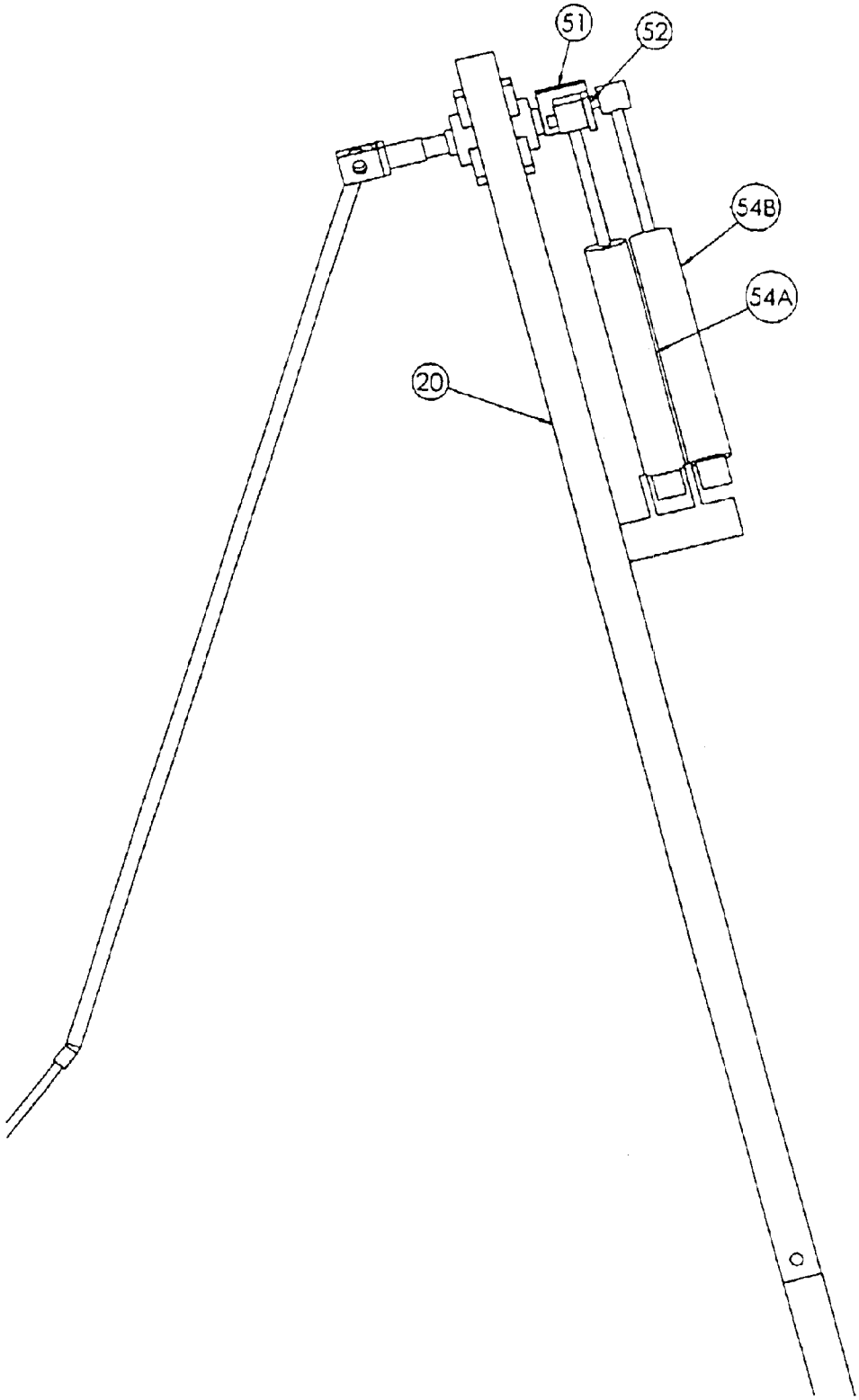
FIG. 12 is a side view.
Figure 13:
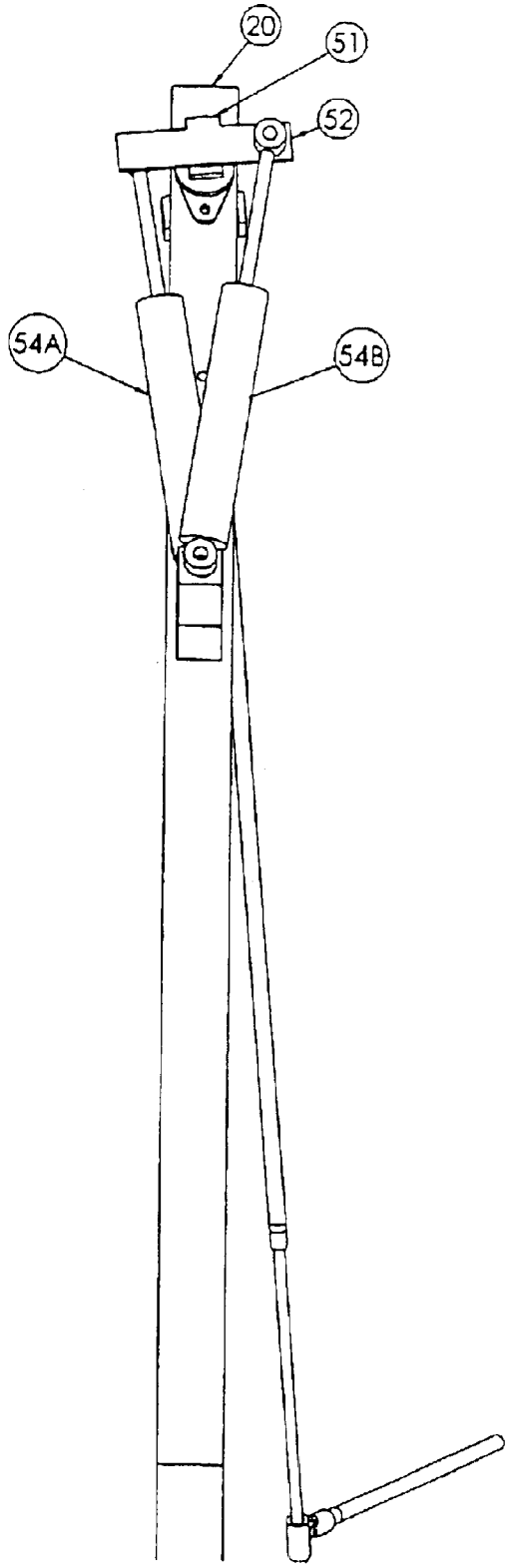
FIG. 13 is a rear view of the offset lever resistance mechanism.

FIGS. 11, 12, and 13 illustrate another preferred embodiment of the resistance mechanism 50, the offset lever mechanism. An L-shaped bracket 51 is rigidly attached to the end of the shaft of joint 30. In resting position, the bracket extends up above the shaft of joint 30 and then extends outward away from the frame 20. A lever 52 is rigidly attached to the bracket 51, such that the center of the lever 52 is rigidly attached to the bottom of the extended portion of the bracket 51, and the lever 52 extends out horizontally (in resting position) equidistant on each side. Two hydraulic cylinders 54*a* and 54*b* are rotatably attached to the frame 20 some distance below the lever 52 at points directly below the two ends of the lever 52 in horizontal, resting position. The pistons of the two hydraulic cylinders 54*a* and 54*b* extend upward and connect rotatably to the faces of the lever 52 on the respective ends of the lever 52 (when the lever 52 is horizontal), such that the pistons of the hydraulic cylinders 54*a* and 54*b* are approximately vertical when the lever 52 is in horizontal mode. In this initial rest position, the pistons of both hydraulic cylinders 54*a* and 54*b* extend up approximately half of their stroke length. The hydraulic cylinders are mounted a distance below the lever 52 relative to the length of the piston stroke, and the piston stroke must be sufficiently long to span the maximum up/down displacement caused by rotation of the lever 52 during a full swing.

More specifically, one of the pistons of the hydraulic cylinders 54 attaches rotatably to the inner face of the lever 52 on one end of the lever 52, while the other piston attaches to the outer face of the lever 52 on the other end of the lever 52 (i.e. they attach on opposite ends of the lever 52 and on opposite faces of the lever 52). Thus, the rotary connections between the pistons of the two cylinders 54*a* and 54*b* and the lever 52 (on the opposite ends—one on the left end and one on the right end—of the lever 52 when it is horizontal) are offset by the thickness of the lever 52, such that one of the rotatable connections is on the inside surface of the lever 51 (towards the frame 20) and the other rotatable connection is on the outside surface of the lever 51 (away from the frame 20). The bracket 51 must extend away from the shaft of joint 30 a sufficient distance to provide clearance for the pistons of the hydraulic cylinders 54. The resistance provided by the hydraulic cylinders will vary depending in part upon the length of the lever 52.

To employ the GSC 10 to condition the muscles used during a swing, the user will stand on the base platform 24 facing the mechanical linkage 25 and the frame 20 at approximately a right angle to the handle 45 of the mechanical linkage 25. The user addresses the handle 45 of the mechanical linkage 25 as if it were the handle of the club actually used in the sport, golf for example, and holds the handle 45 in the appropriate manner. The user may then swing the handle 45 as if it were the club, employing a natural swing as used in the particular sport. The mechanical linkage 25 will pivot about joint 30 to provide a natural swinging motion. If the GSC 10 being used is of the type in the second preferred embodiment, it will automatically adjust to the user. If, however, the GSC 10 being used is of the type in the first preferred embodiment, then the user will have to pre-set the height of the frame 20 and the arm-35 (all other adjustments will be automatic). And, if the GSC 10 being used has an adjustable resistance mechanism 50, then the user may want to adjust the level of resistance to fit their needs.

What we claim is:

1. A swing conditioning device comprising:

a frame;

a mechanical linkage;

a means for resisting rotation;

wherein said mechanical linkage is rotatably supported by said frame, said means for resisting rotation acts to resist the rotation of said mechanical linkage, and said swing conditioning device further comprises at least six movement planes;

wherein said mechanical linkage further comprises an arm and a handle; wherein said arm further comprises an upper rod and a lower rod; wherein said upper rod is essentially vertical when hanging in its initial resting position; wherein one end of said lower rod is rigidly attached to the bottom end of said upper rod and said lower rod extends out from said upper rod in a direction away from said frame;

wherein said handle is rotatably, slidably, and pivotally attached to said lower rod of said arm; and wherein said handle is rotatable about its own center axis.

2. A swing conditioning device as in claim 1 wherein said swing conditioning device further comprises at least six free-moving joints.

3. A swing conditioning device as in claim 1 wherein said swing conditioning device further comprises at least six free-moving joints.

4. A swing conditioning device as in claim 1 wherein said lower rod of said arm extends out from the bottom end of said upper rod at an angle greater than or equal to 90 degrees but less than 180 degrees from said upper rod.

5. A swing conditioning device as in claim 1 wherein said lower rod of said arm extends out from the bottom end of said upper rod at an angle between 150 degrees and 170 degrees from said upper rod.

6. A swing conditioning device as in claim 1 wherein said arm of said mechanical linkage is rotatably and pivotally attached to said frame such that said arm may rotate laterally and may pivot depthwise.

7. A swing conditioning device as in claim 6 wherein said means for resisting rotation is rigidly attached to said frame on the side of said frame away from said mechanical linkage.

8. A swing conditioning device as in claim 6 further comprising a base platform, wherein said frame further comprises an essentially vertical longitudinal member, and wherein the bottom end of said frame is rigidly attached to said base platform.

9. A swing conditioning device as in claim 8 wherein said mechanical linkage is attached to said frame and wherein said mechanical linkage hangs down from near the top of said frame towards but not contacting said base platform.

10. A swing conditioning device as in claim 6 wherein said means for resisting rotation further comprises one or more hydraulic cylinders with pistons and a means for connecting said pistons of said one or more hydraulic cylinders to said arm of said mechanical linkage.

11. A swing conditioning device as in claim 6 wherein said six free-moving joints have essentially no internal resistance.

12. A swing conditioning device comprising:

a frame;

a mechanical linkage; and a means for resisting rotation;

wherein said mechanical linkage is rotatably attached to said frame, said means for resisting rotation acts to resist the rotation of said mechanical linkage, and said mechanical linkage further comprises at least six free-movement joints;

wherein said mechanical linkage further comprises an arm and a handle; wherein said arm of said mechanical linkage is rotatably and pivotally attached to said frame such that said arm may rotate laterally and may pivot depth wise; where said arm further comprises an upper rod and a lower rod; wherein said upper rod is essentially vertical when hanging in its initial resting position; wherein one end of said lower rod is rigidly attached to the bottom end of said upper rod and said lower rod extends out from said upper rod in a direction away from said frame;

wherein said handle is rotatably, slidably, and pivotally attached to said lower rod of said arm; wherein said handle is rotatable about its own center axis; and wherein said lower rod of said arm extends out from the bottom end of said upper rod at an angel between 150 degrees and 170 degrees from said upper rod.

13. A swing conditioning device as in claim 12 wherein said means for resisting rotation further comprises an even number of hydraulic cylinders with pistons, and a means for connecting said pistons of said hydraulic cylinders to said arm of said mechanical linkage; wherein said means for connecting said pistons of said hydraulic cylinders to said arm further comprises:

a shaft;

an upper pulley wheel;

a lower pulley wheel; and a chain;

wherein one end of said shaft is rigidly attached to said arm of said mechanical linkage such that rotation of said arm results in rotation of said shaft;

wherein said upper pulley wheel is rigidly attached to the end of said shaft not attached to said arm such that said arm, said shaft, and said upper pulley wheel rotate in unison;

wherein said lower pulley wheel is rotatably attached to said frame below said upper pulley wheel;

wherein said chain connects said upper pulley wheel and said lower pulley wheel such that rotation of said upper pulley wheel is transmitted via said chain to said lower pulley wheel;

wherein said hydraulic cylinders are rotatably attached to said frame beneath said lower pulley wheel; and wherein said pistons of said hydraulic cylinders are rotatably attached to a face of said lower pulley wheel; and wherein half of said even number of said hydraulic cylinders are located on each side of the axis of rotation of said lower pulley wheel, equidistant from said frame.

14. A swing conditioning device comprising a mechanical linkage with six or more movement planes, wherein said mechanical linkage further comprises an arm, a handle, and a means for support of said mechanical linkage, wherein said arm further comprises an upper rod; a lower rod; wherein said upper rod is essentially vertical; wherein one end of said lower rod is rigidly attached to the bottom end of said upper rod and said lower rod extends out from said upper rod in a direction away from said means for support at an angle equal to or greater than 90 degrees but less than 180 degrees; wherein said handle is rotatably, slidably, and pivotally attached to said lower rod of said arm; wherein said arm of said mechanical linkage is rotatably and pivotally attached to said means for support such that said arm may rotate laterally and may pivot depth wise; and wherein said handle is rotatable about its own center axis.

15. A swing conditioning device as in claim 14 further comprising a means for resisting rotation, wherein said means for resisting rotation acts to resist the rotation of said mechanical linkage.

16. A swing conditioning device as in claim 15 wherein said six or more movement planes of said mechanical linkage further comprise free-moving joints, and have essentially no internal resistance.

* * * * *